US011779983B1

(12) United States Patent
Winn et al.

(10) Patent No.: US 11,779,983 B1
(45) Date of Patent: Oct. 10, 2023

(54) TUBE STRAIGHTENING TOOL AND METHOD OF STRAIGHTENING A TUBE

(71) Applicant: United States of America as represented by the Administrator of the National Aeronautics and Space Administration, Washington, DC (US)

(72) Inventors: Ross Winn, Houston, TX (US); Anthony Hood, Houston, TX (US); Heather Bergman, Houston, TX (US); Curtis Newman, Houston, TX (US); Eric Breaux, Houston, TX (US)

( * ) Notice: Subject to any disclaimer, the term of this patent is extended or adjusted under 35 U.S.C. 154(b) by 220 days.

(21) Appl. No.: 17/381,184

(22) Filed: Jul. 20, 2021

(51) Int. Cl.
*B21D 3/10* (2006.01)

(52) U.S. Cl.
CPC ..... *B21D 3/10* (2013.01)

(58) Field of Classification Search
CPC ... B21D 3/10; B21D 3/00; B21D 3/16; B21D 3/14; B21F 1/026
USPC ..... 72/31.03
See application file for complete search history.

(56) References Cited

U.S. PATENT DOCUMENTS

| | | | | |
|---|---|---|---|---|
| 1,350,649 | A | 8/1920 | Geier | |
| 1,836,041 | A | 12/1931 | Risketts | |
| 1,872,384 | A | 8/1932 | Torvald | |
| 2,531,728 | A | 11/1950 | Gersh | |
| 3,103,963 | A | 9/1963 | Dove | |
| 3,456,467 | A | 7/1969 | Hogarth | |
| 3,776,019 | A | 12/1973 | Shaw | |
| 4,116,037 | A | 9/1978 | Honeycutt | |
| 4,184,356 | A | 1/1980 | Wittmer | |
| 4,483,175 | A | 11/1984 | Hansen | |
| 4,667,501 | A | 5/1987 | Martin | |
| 5,161,584 | A | 11/1992 | Krainaker et al. | |
| 5,653,139 | A | 8/1997 | Lee | |
| 6,234,000 | B1 * | 5/2001 | Bowling | B21D 3/16 72/466.8 |

(Continued)

FOREIGN PATENT DOCUMENTS

| | | | |
|---|---|---|---|
| EP | 1829626 | B1 | 9/2007 |
| WO | 2017055065 | A1 | 4/2017 |
| WO | 2019216659 | A1 | 11/2019 |

OTHER PUBLICATIONS https://www.amazon.com/K-Tool-International-KTI72346-Tube-Straightener/dp/B078FZ6L9H (accessed Mar. 24, 2021).

(Continued)

*Primary Examiner* — Bobby Yeonjin Kim
(74) *Attorney, Agent, or Firm* — Kurt G. Hammerle; Edward K. Kein

(57) ABSTRACT

A tube straightening tool includes a tool housing having an exterior defining a tube entrance opening that opens into a first end of an internal cavity, and has an interior end wall at a second end of the internal cavity. The tool housing has an interior side wall extending from the tube entrance opening toward the interior end wall. A press block is in the internal cavity and a knob is external to the tool housing. A threaded shaft extends from the knob through the shaft opening into the internal cavity. The press block is coupled to the threaded shaft. Turning the knob moves the press block toward the interior side wall, and an exterior of a tube resting in the internal cavity is confronted by the press block and moved against the interior side wall. A method of straightening a tube using the tool is disclosed.

20 Claims, 7 Drawing Sheets

(56) References Cited

U.S. PATENT DOCUMENTS

| | | | | |
|---|---|---|---|---|
| 7,836,740 | B2 | 11/2010 | Launius | |
| 8,087,277 | B2 * | 1/2012 | Umeda | B21C 37/155 72/31.06 |
| 9,751,121 | B2 | 9/2017 | Murphy | |
| 10,005,115 | B2 | 6/2018 | Badea et al. | |
| 10,300,517 | B2 * | 5/2019 | Schulte | B21C 51/00 |
| 2019/0240712 | A1 * | 8/2019 | Semeraro | B25B 1/2457 |

OTHER PUBLICATIONS https://www.amazon.com/BrakeQuip-BQ1028-Tube-Straightener-16/dp/B00BPYC1PM (accessed Mar. 24, 2021).
https://www.amazon.com/PrimoChill-Hand-Held-Pipe-Straightening/dp/B01B1Y6VFG (accessed Mar. 24, 2021).
https://shqipang.en.made-in-china.com/product/tyYndcQVaghz/China-Qipang-Steel-Wire-Straightener-Tube-Pipe-Copper-Straightening-Device.html (accessed Mar. 24, 2021).
https://www.woodwardfab.com/product-category/product/pipe-and-tube-fabrication/tube-straightener/ (accessed Mar. 24, 2021).
https://www.eastwood.com/eastwood-handheld-tubing-straightener-3-16.html (accessed Mar. 24, 2021).
https://www.jegs.com/i/JEGS/555/80082/10002/-1 (accessed Mar. 24, 2021).
https://www.eastwood.com/tube-straightener.html (accessed Mar. 24, 2021).
https://www.amazon.com/BrakeQuip-BQ1030-Brake-Tube-Straightener/dp/B0791YF6KJ (accessed Mar. 24, 2021).
https://www.holley.com/products/plumbing_an_fittings_and_hose/plumbing_tools/tubing_straightener/parts/039ERL (accessed Mar. 24, 2021).
https://www.ebay.com.au/itm/Heavy-Duty-Brake-Pipe-Line-Tube-Straightener-Straightening-Tool-Pliers-/292148339013 (accessed Mar. 24, 2021).
https://www.eastwood.com/professional-brake-tubing-flaring-tool.html (accessed Mar. 24, 2021).
https://hvactools.co.nz/product/kwix-c12354-tube-straightener-3/ (accessed Mar. 24, 2021).
https://www.inlinetube.com/products/tlf11 (accessed Mar. 24, 2021).
https://www.youtube.com/watch?v=DuXbKH8wzqs (accessed Mar. 24, 2021).
https://www.alibaba.com/product-detail/0-5-4mm-brake-tube-straightener_60722475055.html (accessed Mar. 24, 2021).
https://thefittingsource.com/product-details/ssp-benchtop-tube-straightener/ (accessed Mar. 24, 2021).
https://www.amazon.com/AdlerSpeed-Coiled-Straight-Straightener-Aluminum/dp/B07BBQM85D (accessed Mar. 24, 2021).
https://www.lasertools.co.uk/product/5968/Tube-Straightener-4.75-12.7mm (accessed Mar. 24, 2021).
https://www.amazon.com/PS-100-Adjustable-Tubing-Straightener/dp/B07FFHSYM7 (accessed Mar. 24, 2021).
https://www.kwixuk.com/product.html (accessed Mar. 24, 2021).
screwfix.com Tecti1e Classic Tube Straight, Not found.
Brake Pipe PEX Tube Line Table . . . ebay.com, not found.

* cited by examiner

TUBE STRAIGHTENING TOOL AND METHOD OF STRAIGHTENING A TUBE

STATEMENT OF GOVERNMENT INTEREST

The embodiments described herein may be manufactured and used by or for the Government of the United States of America for governmental purposes without payment of any royalties thereon or therefor.

TECHNICAL FIELD

The present disclosure relates to a tube straightening tool and a method of straightening a tube using the same.

BACKGROUND

Tubes may be used as conduits for fluids, such as gasses and liquids. The end of the tube may be connected to another component through which the gas or liquid flows. In some implementations, the end of the tube should be straight in order to ensure a leakproof connection. Some tubes may need to be straightened prior to connecting. For example, tubes of a softer material may bend during handling and need to be straightened prior to connection.

SUMMARY

A leakproof connection is desirable for conduit tubes. This type of connection depends in part on fully inserting a straight and unscratched end of the tube into a fitting. A tube straightening tool and method of straightening a tube are disclosed herein that ensure that a desired length at the end of the tube (e.g., the tip of the tube) is straightened without a risk of introducing linear scratches that could create a leak path at the fitting. Avoiding linear scratches at the end of the tube is desirable, as a scratch on the exterior of the tube that extends at least partially lengthwise (e.g., past the fitting), may create a leak path, especially when high pressure gas flows in the tube. Many available tube straighteners, such as those that require sliding the tube through the straightener under resistance (e.g., during straightening), introduce linear scratches. Many available tube straighteners also do not include a way to measure the length of tube straightened, so the operator must do so with a separate tool. The tube straightening tool and method provided herein accomplish both of these goals via a portable and easy to use tool that functions equally well on earth and in space.

A tube straightening tool for straightening a length of tube includes a tool housing defining an internal cavity and having an exterior defining a tube entrance opening that opens into a first end of the internal cavity. The tool housing also defines a shaft opening orthogonal to the tube entrance opening. The shaft opening also opens into the internal cavity. The tool housing has an interior end wall at a second end of the internal cavity, and has an interior side wall extending from the tube entrance opening toward the interior end wall. A press block is disposed in the internal cavity. A knob is external to the tool housing, and a threaded shaft extends from the knob through the shaft opening and into the internal cavity. The press block is coupled to the threaded shaft. Turning the knob in a first direction moves the press block in the internal cavity toward the interior side wall, and turning the knob in a second direction opposite from the first direction moves the press block away from the interior side wall. With this configuration of the tube straightening tool, an exterior of a tube inserted through the tube entrance opening and resting in the internal cavity will be confronted by the press block and moved against the interior side wall to straighten the tube.

The tube straightening tool is configured to minimize movement of the tube in a direction along its longitudinal axis while under resistance during the straightening process. Longitudinal scratches at the exterior of the tube are thus minimized. For example, the tube entrance opening may be elongated in a direction from the interior side wall toward the press block. This elongation will allow a bent end of a tube to be inserted without resistance. Additionally, the internal cavity is sufficiently wide relative to the size of tube to be straightened that, even for a relatively severely bent tube, the tube is not moved longitudinally against any resistance when being inserted into the internal cavity. If the operator feels resistance when inserting a bent tube into the internal cavity, the operator can stop inserting the tube, and then operate the knob to apply force against the side of the tube with the press block while the tube is resting in the internal cavity. Because the tube is at rest when the press block contacts the side of the tube, and the press block moves orthogonally to the longitudinal axis of the tube (if the tube were straight) rather than along a length of the tube, movement of the tube along its longitudinal axis relative to the press block during straightening is minimal.

In some implementations, the interior side wall may have a stationary tube contact surface configured as a groove facing the press block and extending lengthwise along the internal cavity from the tube entrance opening toward the interior end wall. The press block may have a tube contact surface configured as a groove facing the interior side wall and extending lengthwise parallel with the groove of the stationary tube contact surface. As the tube contact surface of the press block moves closer to the stationary tube contact surface of the interior side wall, bends in the tube are lessened to no more than the distance between these two surfaces. In an embodiment for straightening tubing with a circular cross-section, for example, the groove of the stationary tube contact surface of the interior side wall and the groove of the tube contact surface of the press block are both semi-circular.

In order to ensure that the portion of the tube nearest the end of the tube is protected from scratches and is straight, a tube sleeve may be disposed in a portion of the cavity adjacent the interior end wall (e.g., a second cavity portion). The tube sleeve has a linear passage extending lengthwise through the tube sleeve from a first end of the tube sleeve at a portion of the cavity nearest the tube entrance opening (e.g., a first cavity portion) to a second end of the tube sleeve at the interior end wall. A longitudinal center axis of the linear passage aligns with a longitudinal center axis of the groove of the stationary tube contact surface of the interior side wall. The tube sleeve may be a first material, the tool housing may be a second material, and the first material may be softer than the second material. If the portion of the tube nearest the tube end (also referred to as the tip) is sufficiently straightened by the press block in the first portion of the cavity it can be slid into further into the internal cavity (e.g., into the linear passage) with little or no resistance, and, in any event, any resistance would be lessened by the relatively soft material. The portion of the tube near the tube end remains in the linear passage of the tube sleeve while a portion of the tube slightly further from the tip is now in the first portion of the internal cavity, and may be straightened by the press block.

The tube straightening tool may have features that aid the operator in ensuring that a desired length of the tube has been straightened (e.g., the length of the tube that is needed for a leakproof connection to the fitting). For example, the tool housing may define a window extending through the tool housing to the internal cavity at the interior end wall. The operator can then view the end of the tube at the interior end wall to ensure that the tube has been fully inserted into the tool housing. The distance from the entrance opening to the interior end wall may be the same or greater than the length to be straightened to ensure a leak free connection at the end of the tube (e.g., is the predefined distance).

Alternatively or in addition, the exterior of the tool housing may define a linear groove having a length equal to the distance from the entrance opening to the interior end wall. The operator may use these features to verify that the end of the tube contacts the interior end wall. For example, the operator may view the end of the tube at the interior end wall through the window. The operator may mark the tube at the predefined distance from the end of the tube by laying the tube in the linear groove in the exterior of the tool housing, or the operator may mark the tube at the entrance opening after inserting the tube until the end of the tube contacts the interior end wall. Marking the tube may be with an ink marker or with tape, for example. With the marked tube, the operator can insert the tube end into a connector fitting to the marking and be assured that the tube end is fully inserted.

The tube straightening tool may also have features that aid the operator in determining how far and in which direction to rotate the knob during the straightening process. For example, the tool housing may have a counterbore at the exterior of the tool housing around the shaft opening. The tube straightening tool may include a bushing fixed to the threaded shaft. The bushing may move at least partially into the counterbore when the knob is turned in the first direction and may move at least partially out of the counterbore when the knob is turned in the second direction. By viewing the position of the bushing relative to the housing at the counterbore, the operator is informed of the position of the press block in the internal cavity (e.g., whether it is relatively close to the interior side wall, or relatively far from the interior side wall) and, accordingly, which way to turn the knob.

The tube straightening tool may have features that couple the press block to the shaft so that the shaft can rotate relative to the press block with the knob, but not move axially relative to the press block. For example, the press block may have a blind hole extending partially through the press block. The threaded shaft may extend into the blind hole, and the press block may have a shaft access opening extending at least partially through the press block orthogonal to and in communication with the blind hole. A retainer clip may be disposed in the shaft access opening with a narrowed portion of the threaded shaft in a notch of the retainer clip to fix the threaded shaft axially relative to the press block.

The tool housing may have internal threads at the shaft opening, and the threaded shaft may have an externally-threaded portion that threads to the internal threads. The threaded shaft may also have a terminal end portion opposite the knob, and the narrowed portion may be between the externally-threaded portion and the terminal end portion. A diameter of the narrowed portion is less than a diameter of the terminal end portion and less than a diameter of the externally-threaded portion. A width of the notch is less than the diameter of the terminal end portion and less than the diameter of the externally-threaded portion. The shaft access opening is wider than the blind hole, and wider than the retainer clip. With this configuration, the retainer clip locks the shaft axially relative to the press block.

In some embodiments, the straightening tool may include a cover plate fastenable to the tool housing to enclose the internal cavity. The cover plate may define a window extending through the cover plate to the internal cavity at the interior end wall when the cover plate is fastened to the tool housing. Like the window in the tool housing, the window in the cover plate can be used to determine whether the tube is fully inserted to the end wall.

Accordingly, during assembly, the press block can be inserted into the internal cavity, the shaft extended into the shaft opening, the retainer clip then placed around the shaft in the shaft access opening. The sleeve may also be placed in the internal cavity. Once the components are in the internal cavity, the cover plate may be fastened to the housing to enclose the components in the internal cavity.

The tube straightening tool may have additional features making it easy for an operator to carry and use, especially in space, where diminished gravitational forces may require retaining the tool to prevent it floating away from the operator. The exterior of the tool housing may have a first ridge, a second ridge spaced from the first ridge, and a tool mount portion recessed between the first ridge and the second ridge. For example, the tool mount portion may be relatively flat, and a supporting apparatus may be mounted to the tube straightening tool at the tool mount portion to support the tool during use and hold it in place, leaving the operator's hands free to manipulate the tube. The ridges help to prevent movement of the tool relative to the supporting apparatus.

Another convenience feature for the operator may include a through hole extending through the tool housing orthogonal to the entrance opening at an end of the tool housing opposite from the entrance opening. For example, the tool housing may form a ring around the through hole, and the tool may be connected to the operator's belt, for example, with a connector extending through the through hole around the ring.

A method of straightening a tube using the tube straightening tool includes inserting an end of a tube at least partially into the internal cavity through the entrance opening so that the tube is in an initial resting position in the internal cavity. The method further includes turning the knob in a first direction to move the press block toward the interior side wall and into contact with an exterior of the tube to force the tube toward the interior side wall. Next, the knob is turned in a second direction to move the press block away from the interior side wall and out of contact with the exterior of the tube.

The position of the tube within the internal cavity can then be adjusted to a subsequent resting position, such as by rotating the tube at least partially about its longitudinal axis so that another orientation of the tube is presented to the press block for straightening, by inserting the tube further into the internal cavity so that the press block can act against a new portion of the tube, or by both rotating the tube about its longitudinal axis and inserting the tube further into the internal cavity.

The knob is then turned in the first direction again to move the press block toward the interior side wall and into contact with the exterior of the tube to force the tube toward the interior side wall. Manipulating the resting position of the tube within the internal cavity by rotating the tube and/or by inserting the tube further into the cavity may thus be accomplished in stages, with each repositioning of the tube occurring without resistance from the press block or the tool housing, as the press block is first moved out of contact with the tube when the knob is rotated in the second direction prior to each manipulation of the tube. Eventually, the tube may be inserted without resistance until an end of the tube contacts the interior end wall.

The method may include verifying that the end of the tube contacts the interior end wall by viewing the end of the tube at the interior end wall through a window extending through the tool housing at the interior end wall and/or through a window extending through a cover plate at the interior end wall when the cover plate is fastened to the tool housing.

The method may include marking the tube at a predefined distance from the end of the tube by laying the straightened tube in a linear groove in the exterior of the tool housing. The linear groove has a length equal to the predefined distance. Alternatively, the tube may be marked at the entrance opening after inserting the tube until the end of the tube contacts the interior end wall. The tube straightening tool is configured so that a distance from the entrance opening to the interior end wall equal to the predefined distance.

The above summary is not intended to represent every embodiment or aspect of the present disclosure. Rather, the foregoing summary exemplifies certain novel aspects and features as set forth herein. The above noted and other features and advantages of the present disclosure will be readily apparent from the following detailed description of representative embodiments and modes for carrying out the present disclosure when taken in connection with the accompanying drawings and the appended claims.

BRIEF DESCRIPTION OF THE DRAWINGS

The drawings described herein are for illustrative purposes only, are schematic in nature, and are intended to be exemplary rather than to limit the scope of the disclosure.

DETAILED DESCRIPTION

Figure 1:
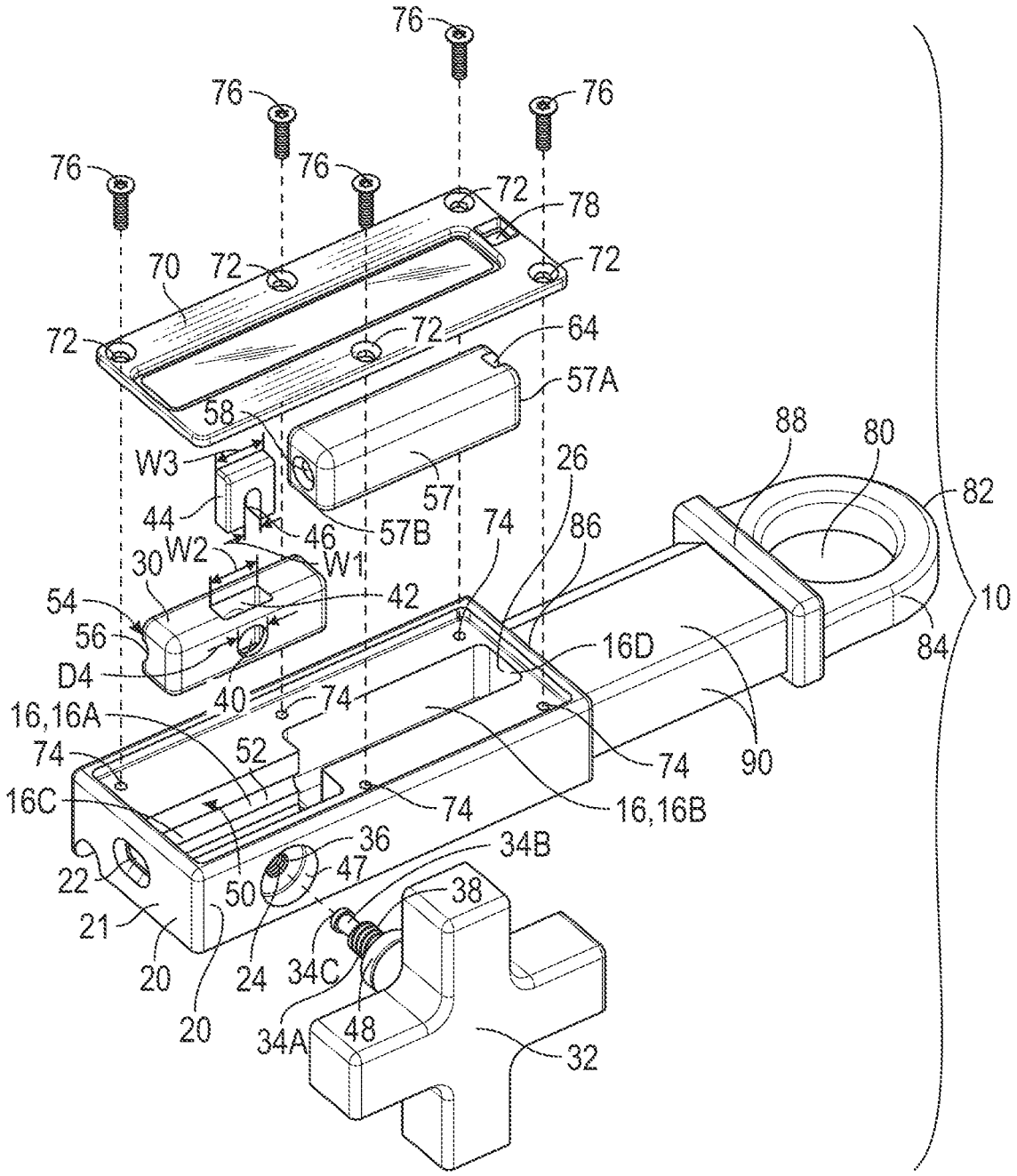
FIG. 1 is an exploded perspective view of a tube straightening tool.

With reference to the drawings, wherein like reference numbers refer to the same or similar components throughout the several views, an example tube straightening tool 10 is shown schematically in exploded view in FIG. 1. The tube straightening tool 10 straightens a length of a tube 12 shown in phantom in FIGS. 2 and 3. The tube straightening tool 10 includes a tool housing 14 defining an internal cavity 16. The internal cavity 16 has a first cavity portion 16A and a second cavity portion 16B. An exterior 20 of the tool housing 14 defines a tube entrance opening 22 that opens into a first end 16C of the internal cavity 16. The end 13 of the tube 12 is inserted into the internal cavity 16 at the entrance opening 22. The tool housing also defines a shaft opening 24 orthogonal to the tube entrance opening 22. The shaft opening 24 also opens into the internal cavity 16. The tool housing 14 has an interior end wall 26 at a second end 16D of the internal cavity 16, and has an interior side wall 28 extending from the tube entrance opening 22 toward the interior end wall 26.

Figure 2:
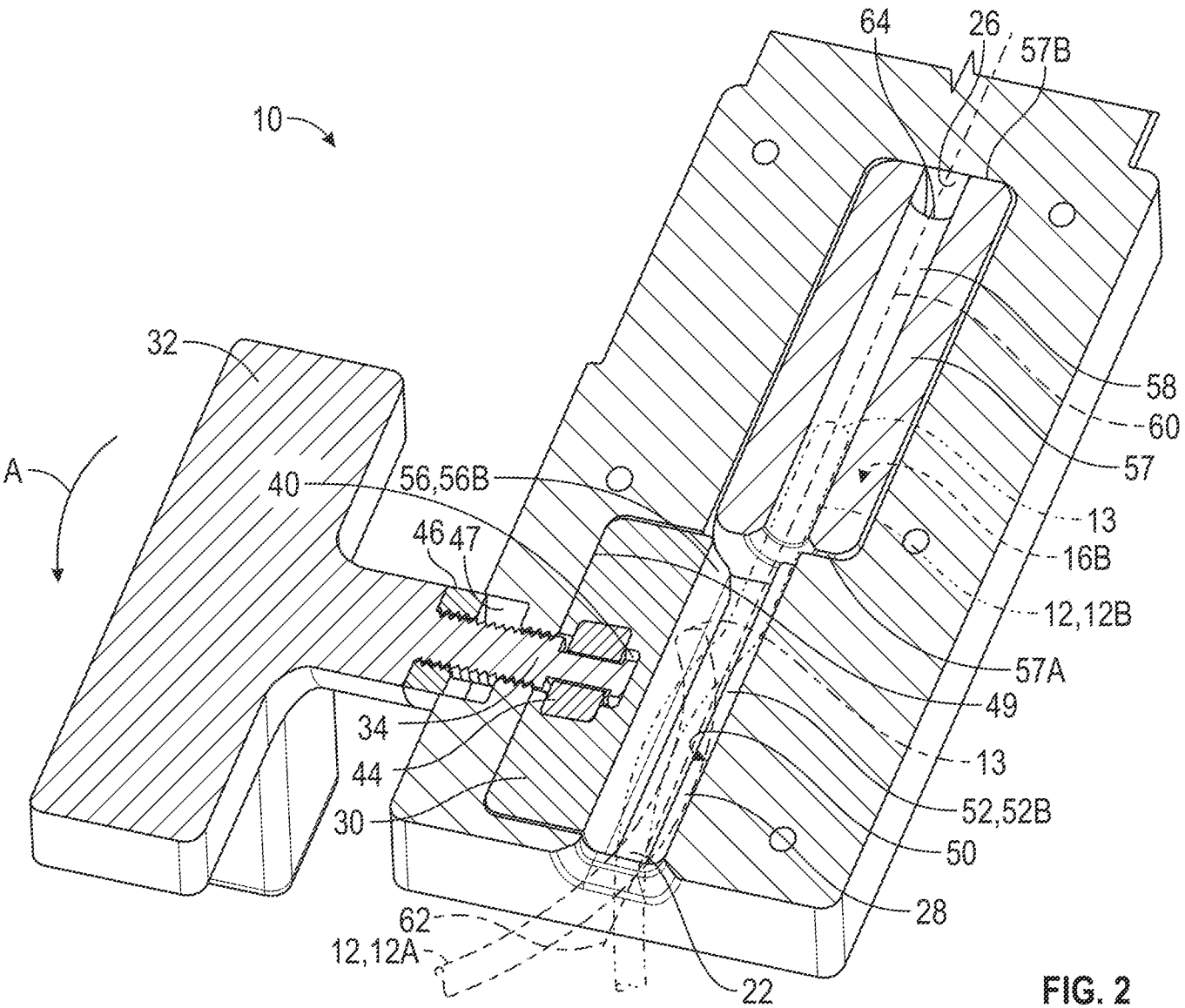
FIG. 2 is a fragmentary cross-sectional view of the tube straightening tool taken at lines 2-2 in FIG. 5 and showing a press block in a first position relative to an interior side wall of a tool housing, and with a portion of a tube shown in fragmentary phantom view.
Figure 3:
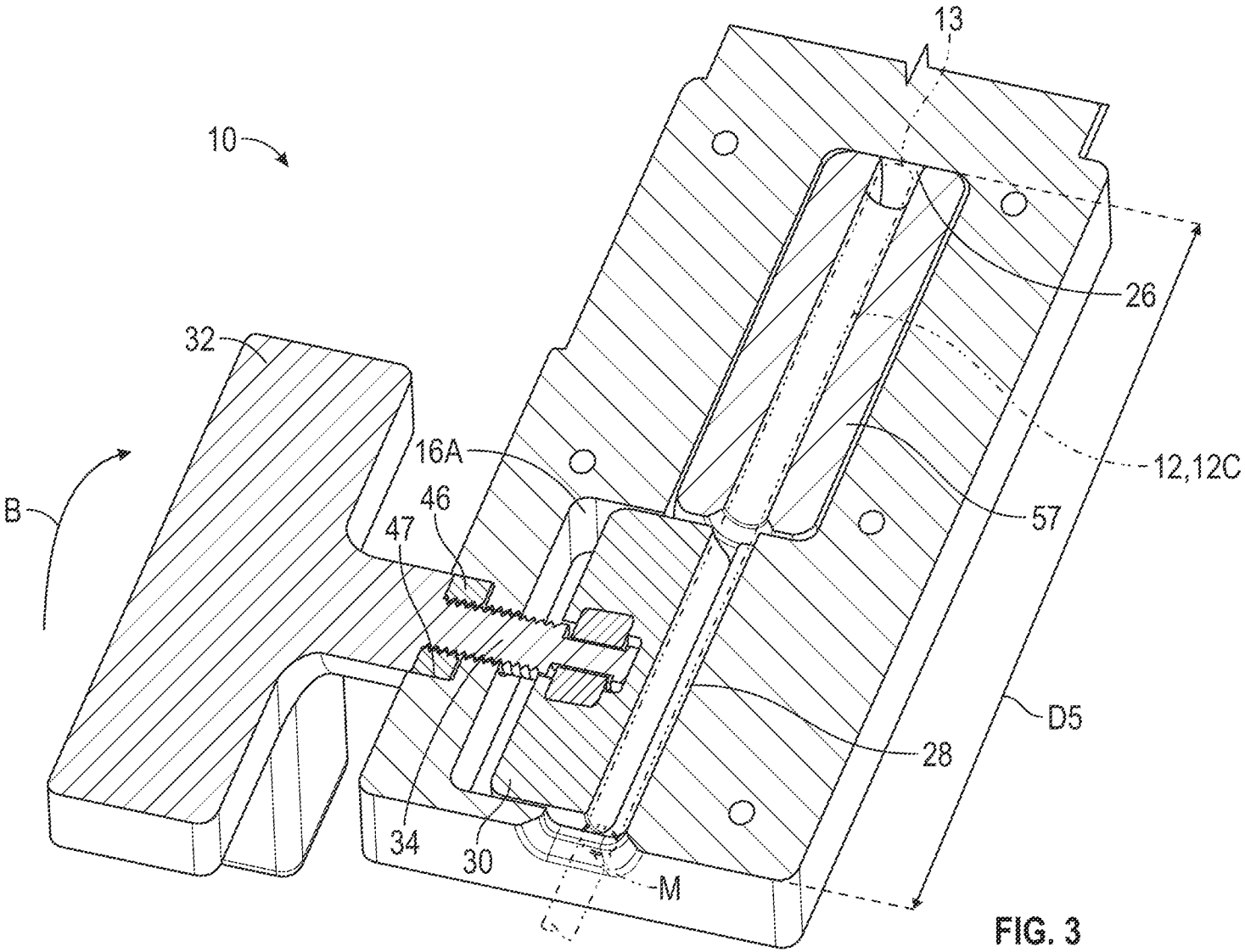
FIG. 3 is a fragmentary cross-sectional view of the tube straightening tool showing the press block in a second position relative to the interior side wall of the tool housing with the tube straightened by the press block.
Figure 4:
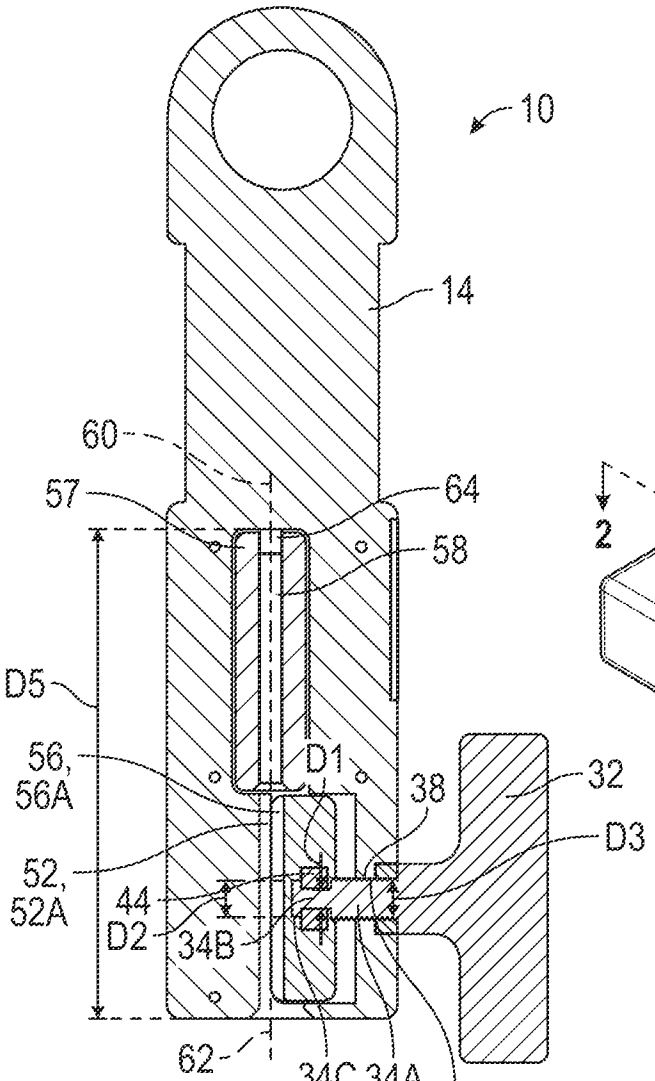
FIG. 4 is a cross-sectional view of the tube straightening tool taken at lines 4-4 in FIG. 8.

The tube straightening tool 10 includes a press block 30 that is configured to be disposed in the first cavity portion 16A, as shown in FIGS. 2-4. Stated differently, the press block 30 is sized and shaped to fit in the first cavity portion 16A. The tube straightening tool 10 also includes a knob 32 that is external to the tool housing 14 when assembled, as shown in FIGS. 2-9.

The tube straightening tool 10 includes a threaded shaft 34 that extends from the knob 32 through the shaft opening 24 and into the internal cavity 16 as shown in FIGS. 2-3. The threaded shaft 34 may be integrally formed as a unitary component with the knob 32 as shown herein. Alternatively, the threaded shaft 34 may be a separate component secured to the knob 32 with a set screw, for example. The tool housing 14 has internal threads 36 at the shaft opening 24. The threaded shaft 34 has external threads 38 at an externally-threaded portion 34A. The external threads 38 thread to the internal threads 36.

The tube straightening tool 10 includes a press block 30 that has a blind hole 40 extending partially through the press block 30. The press block 30 also has a shaft access opening 42 extending at least partially through the press block 30 orthogonal to and in communication with the blind hole 40. The threaded shaft 34 extends into the blind hole 40, as shown in FIGS. 2-4.

The tube straightening tool 10 includes a retainer clip 44 that may be disposed in the shaft access opening 42. The retainer clip 44 has a notch 46. The retainer clip 44 fits to the shaft 34 so that a narrowed portion 34B of the threaded shaft 34 is in the notch 46 when the retainer clip 44 is disposed in the shaft access opening 42 and the threaded shaft 34 is disposed through the blind hole 40 to fix the threaded shaft 34 axially relative to the press block 30. As best shown in FIG. 4, the threaded shaft 34 has a terminal end portion 34C opposite the knob 32. The narrowed portion 34B is between the externally-threaded portion 34A and the terminal end portion 34C. The externally-threaded portion 34A and the terminal end portion 34C have diameters greater than the width of the notch 46 so that the retainer clip 44 locks the shaft 34 axially relative to the press block 30. Referring to FIG. 4, a diameter D1 of the narrowed portion 34B is less than a diameter D2 of the terminal end portion 34C, and less than a diameter D3 of the externally-threaded portion 34A. A width W1 of the notch 46 (see FIG. 1) is less than the diameter D2 of the terminal end portion 34C and less than the diameter D2 of the externally-threaded portion 34A. The shaft access opening 42 has a width W2 greater than the diameter D4 of the blind hole 40, and a width W3 the retainer clip 44 is less than the width W2 of the shaft access opening 42. With this configuration, the retainer clip 44 locks the shaft 34 axially relative to the press block 30.

In this manner, the press block 30 is coupled to the threaded shaft 34 so that it is moved with the threaded shaft 34 axially toward and away from the interior side wall 28 but does not rotate with the threaded shaft 34. The threaded shaft 34 can rotate relative to the press block 30 as the knob 32 is turned so that the threaded shaft 34 moves axially relative to the tool housing 14 as the external threads 38 engage the internal threads 36.

The interior side wall 28 has a stationary tube contact surface 50 configured with a groove 52 facing the press block 30 and extending lengthwise along the internal cavity 16 from the tube entrance opening 22 toward the interior end wall 26. A first half 52A of the groove 52 is shown in FIG. 4, and a second half 52B of the groove 52 is shown in FIG. 2. These halves 52A, 52B are shown on either side of a cutting plane in FIGS. 2 and 4 that extends along the longitudinal center axis 62. As is evident from the two halves 52A, 52B and from the entire groove 52 shown in FIG. 1, the groove 52 is semi-circular (e.g., the stationary tube contact surface 50 is a concave semi-circle at a cross-section perpendicular to the longitudinal center axis 62 of the groove 52 of FIG. 2).

The press block 30 has a tube contact surface 54 configured with a groove 56 facing the interior side wall 28 and extending lengthwise parallel with the groove 52 of the stationary tube contact surface 50. FIG. 1 shows an end of the groove 56. A first half 56A of the groove 56 is shown in FIG. 4, and a second half 56B is shown in FIG. 2. As is evident from the two halves 56A, 56B and from FIG. 1, the groove 56 is semi-circular (e.g., the tube contact surface 54 is a concave semi-circle at a cross-section perpendicular to the longitudinal center axis 62 of FIG. 2). The stationary tube contact surface 50 and the tube contact surface 54 and their respective grooves 52, 56 are thus configured to straighten round tubes (tubes having a circular outer perimeter in a cross section perpendicular to the length of the tube). In other embodiments, the stationary tube contact surface 50 and the tube contact surface 54 could have grooves with other cross-sectional shapes configured for straightening tubes with outer perimeters having other cross-sectional shapes (e.g., oval tubes, square tubes, etc.).

Referring to FIG. 1, the tool housing 14 has a counterbore 47 at the exterior 20 of the tool housing 14 around the shaft opening 24. The tube straightening tool 10 includes a bushing 48 fixed to the threaded shaft 34 between the knob 32 and the externally-threaded portion 34A. For example, the bushing 48 may be adhered to the threaded shaft 34. Although the threads 38 are shown extending under the bushing 48, the threads 38 may be only between the bushing 48 and the narrowed portion.

The bushing 48 has an axial width equal to the depth of the counterbore 47 so that the bushing 48 fits entirely into the counterbore 47 when the knob 32 is moved in the first direction as far as possible (e.g., until the portion of the tube contact surface 54 above and below the groove 56 confronts the portion of the stationary tube contact surface 50 at the interior side wall 28 above and below the groove 52, which occurs when the tube 12 is entirely within the adjacent grooves 52, 56).

The tube straightening tool 10 includes a tube sleeve 57 that is disposed in the second cavity portion 16B adjacent to the interior end wall 26 as shown in FIG. 2. The tube sleeve 57 a has a linear passage 58 extending lengthwise through the tube sleeve 57 from a first end 57A of the tube sleeve 57 at the first cavity portion 16A to a second end 57B of the tube sleeve 57 at the interior end wall 26, as shown in FIG. 2. A longitudinal center axis 60 of the linear passage 58 aligns with a longitudinal center axis 62 of the groove 52 of the stationary tube contact surface 50 of the interior side wall 28 as shown in FIG. 2. The tube sleeve 57 includes a notch 64 extending entirely through the second end 57B orthogonal to the longitudinal center axis 60 of the linear passage 58, as is evident from FIGS. 1 and 4. The linear passage 58 has a cross-sectional shape that is the desired shape and size of the straightened tube 12, such as a cylindrical shape.

Referring again to FIG. 1, the tube straightening tool 10 includes a cover plate 70 with multiple spaced fastener openings 72. The fastener openings 72 align with fastener openings 74 in bottom of the tool housing 14. Fasteners 76 extend through the fastener openings 72 and thread to the tool housing 14 at the fastener openings 74 to secure the cover plate 70 to the tool housing 14. The cover plate 70 extends over the internal cavity 16 and thus retains the retainer clip 44 in the first cavity portion 16A around the shaft 34, and retains the tube sleeve 57 in the second cavity portion 16B. The press block 30 is retained in the first cavity portion 16A due to the shaft 34 extending through the blind hole 40, and the cover plate 70 additionally retains the press block 30 in the internal cavity 16.

Figure 9:
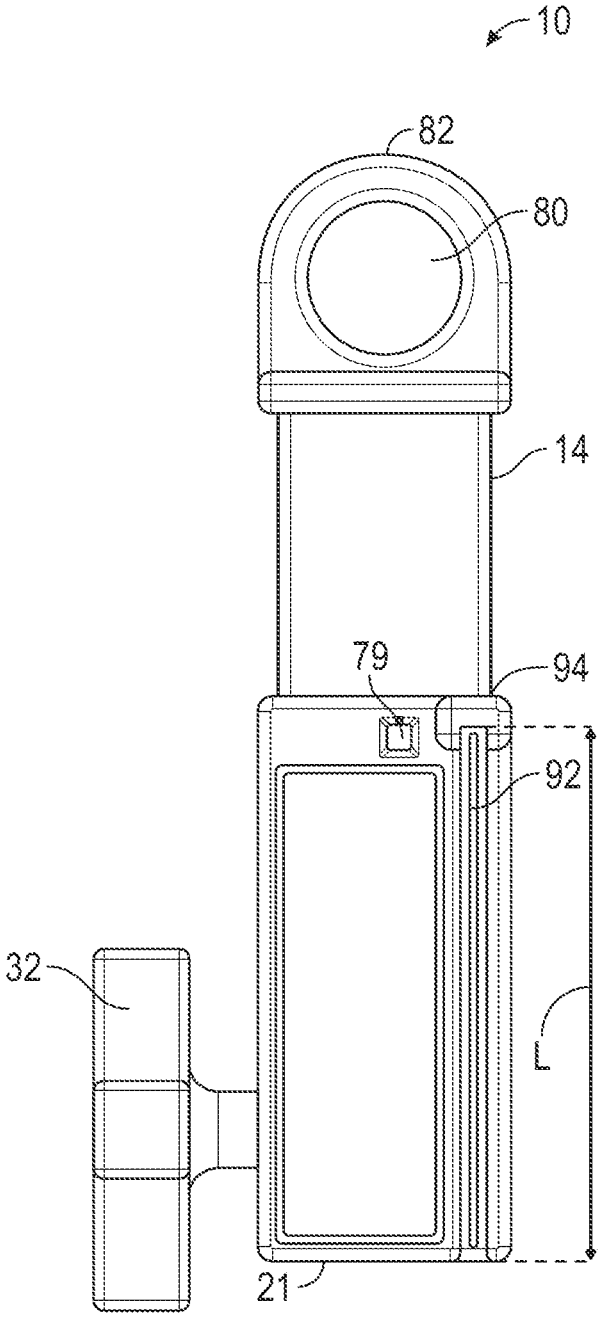
FIG. 9 is a plan view of the top side of the tube straightening tool.

The cover plate 70 has a window 78 that extends through the cover plate 70. When the cover plate 70 is secured to the tool housing 14, the window 78 is disposed over the second cavity portion 16B of the internal cavity 16 at the interior end wall 26 and is aligned with the notch 64. The top of the tool housing 14 also has a window 79, as shown in FIG. 9, that aligns with the window 78 and the notch 64. The windows 78, 79 and the notch 64 enable the operator to verify that the end of the tube 12 is fully inserted to the interior end wall 26 during use.

Figure 6:
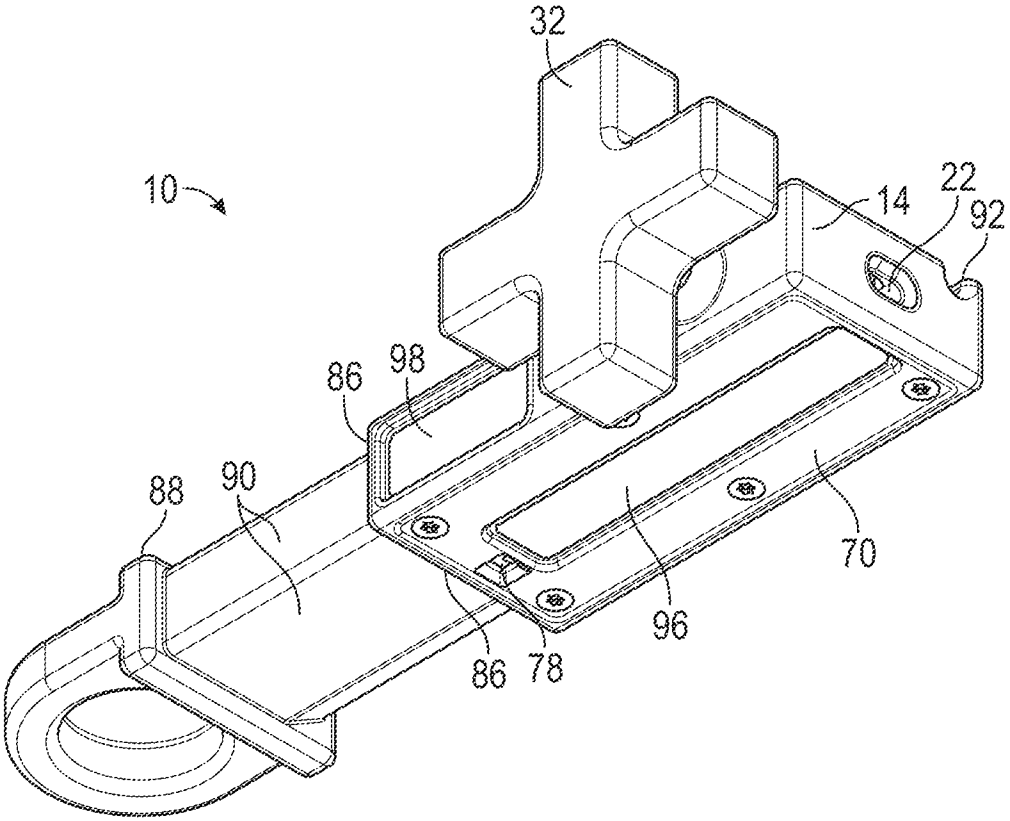
FIG. 6 is a perspective view of a bottom side of the tube straightening tool.
Figure 8:
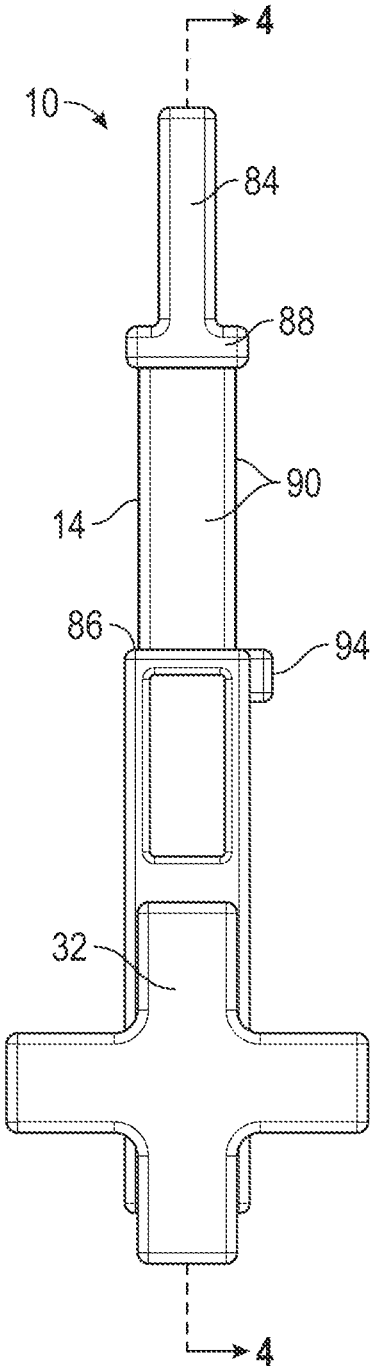
FIG. 8 is a side view of a first side of the tube straightening tool.

The cover plate 70 is relatively flat. Referring to FIG. 6, a label may be adhered to the cover plate 70 at a recessed portion 96. The tool housing 14 has a similar recessed portion 98. A label may also be placed at the recessed portion 98. For example, the label or labels may include a part number or serial number assigned to the tube straightening tool 10 and/or may include instructions for use, etc.

Accordingly, to assemble the tube straightening tool 10, the press block 30 is inserted into the first cavity portion 16A of the internal cavity 16, the knob 32 is positioned so that the shaft 34 extends into the blind hole 40, and the retainer clip 44 is then placed around the narrowed portion 34B of the shaft 34 in the shaft access opening 42. The tube sleeve 57 is placed in the second cavity portion 16B of the internal cavity 16 either before or after inserting the press block 30. The cover plate 70 is then fastened to the tool housing 14 to enclose these components in the internal cavity 16.

Figure 7:
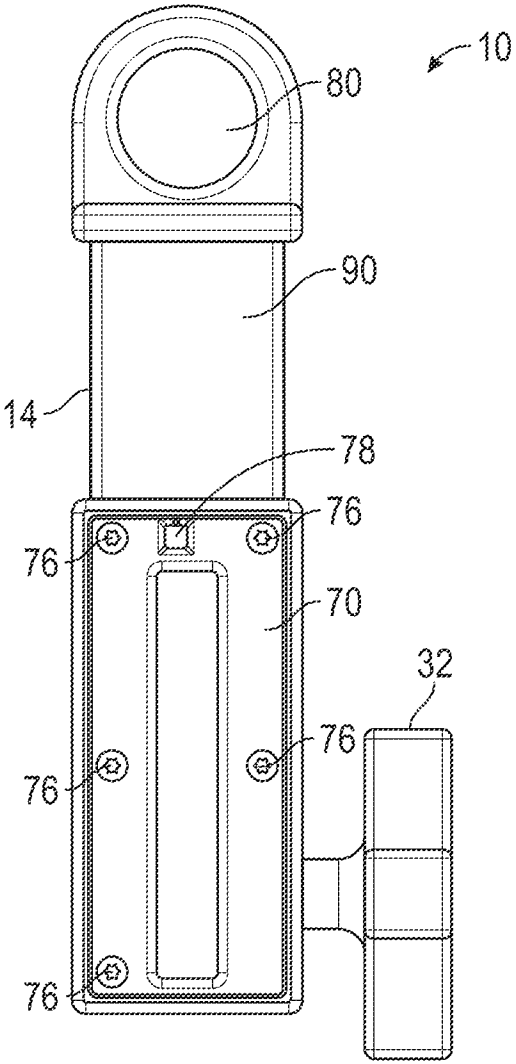
FIG. 7 is a plan view of the bottom side of the tube straightening tool.

The tube straightening tool 10 may have additional features making it easy for an operator to carry and use, especially in space, where the tube straightening tool 10 may need to be retained due to the relatively low gravitational forces. For example, as shown in FIG. 7, the tool housing 14 has a through hole 80 extending through the tool housing 14 orthogonal to the entrance opening 22 at an end 82 of the tool housing 14 opposite from the entrance opening 22. In the embodiment shown, the tool housing 14 forms a ring 84 around the through hole 80. A clip, tie, or other securing mechanism may extend through the through hole 80 around the ring 84 to connect the tube straightening tool 10 to a person or apparatus. The tube straightening tool 10 may be connected to the operator's belt, for example, with a connector ring on the belt extending through the through hole 80 and around the ring 84.

The exterior 20 of the tool housing 14 has a first ridge 86, a second ridge 88 spaced from the first ridge 86, and a tool mount portion 90 recessed between the first ridge 86 and the second ridge 88. The tool mount portion 90 is shown as relatively flat and four-sided, as is evident in FIGS. 5 and 6, for example. The ridges 86, 88 extend outward at the four sides of the tool housing 14, and a supporting apparatus may be mounted to the tube straightening tool 10 at the tool mount portion 90 to support the tube straightening tool 10 during use and hold it in place, leaving the operator's hands free to manipulate the tube 12 as described herein. For example, a retaining tool such as a clamp may be mounted at the tool mount portion 90 to hold the tube straightening tool 10, and the ridges 86, 88 help to limit movement of the clamp on the tube straightening tool 10.

Figure 5:
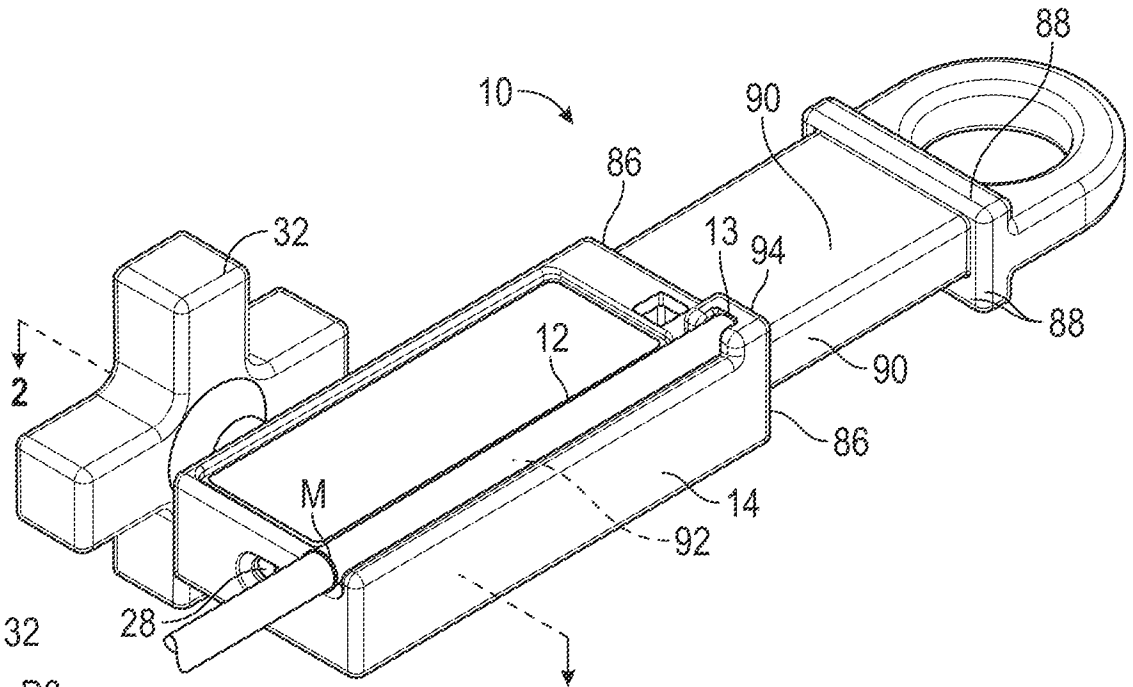
FIG. 5 is a perspective view of a top side of the tube straightening tool.

Referring to FIGS. 5 and 9, the exterior 20 of the tool housing 14 also has a linear groove 92 extending from the end 21 of the tool housing 14 in which the entrance opening 22 is defined toward the end 82. The linear groove 92 has a length L that is equal to the distance D5 indicated in FIG. 4 from the entrance opening 22 to the interior end wall 26. The housing 14 has an elevated stop 94 at the end of the linear groove 92 so that the tube 12 can be slid in the linear groove 92 to the stop 94 to accurately determine a length of the tube from the stop 94 to the end 21 (e.g., the length L). The length L and the distance D5 are predetermined as being equal to a length of the tube 12 that will be inserted into a connector fitting and should be free of linear scratches at its exterior for a secure connection. Stated differently, the tube straightening tool 10 is designed to be used for straightening the tube 12 that will be used with certain types of fittings, such as swage fittings of a certain size or range of sizes, and into which a certain length L of the tube 12 is to be inserted to ensure a secure connection. Additionally, the length of the sleeve 57 may be that portion of the length of tube 12 that is inserted that interfaces most directly with the fitting and, accordingly, is the portion of tube to be straight and without scratches. In one example, tube straightening tool 10 is designed for straightening the last 3.5 inches of 4 millimeter, cylindrical, stainless steel tube 12, so that the length L and distance D5 are both 3.5 inches.

Figure 10:
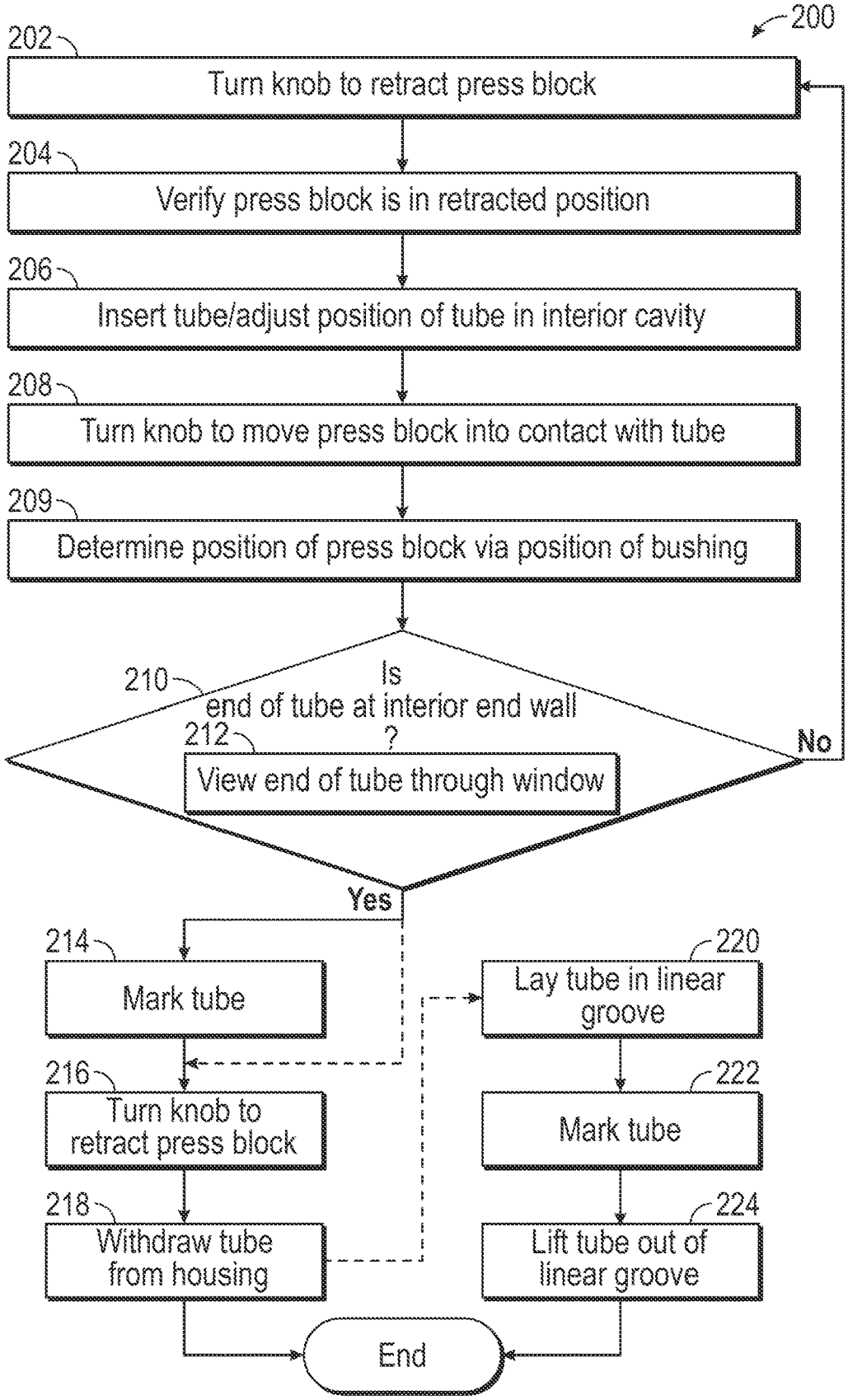
FIG. 10 is a flowchart of a method of straightening a tube using the tube straightening tool.

A method 200 of straightening a tube 12 using the tube straightening tool 10 is indicated in FIG. 10 and is described with respect to FIGS. 2-4. The method 200 may begin with step 202, turning the knob 32 so that the press block 30 is in a retracted position, such as the fully retracted position shown in FIG. 2. Depending upon the direction of the threads 36, 38, this step of turning the knob may be represented by arrow A in FIG. 2 (for example, a traditional right-hand thread will retract by turning the knob counterclockwise when viewed from the direction shown in FIG. 1 and close onto the tube by turning clockwise), which shows the press block 30 in the fully retracted position. Depending upon the severity of the bends in the tube 12, the operator may decide that only a partially retracted position of the press block 30 is needed to enable insertion of the tube 12. If the press block 30 is already in the retracted position, the method 200 may skip step 202 and proceed to step 204.

The method 200 may include step 204, verifying that the press block 30 is in the retracted position. This step may be done by tactile feel, such as may be determined when the knob 32 will not turn any further as the press block 30 abuts an interior side wall 49 of the tool housing 14 when the press block 30 is in the fully retracted position, as shown in FIG. 2. Verification may also be by viewing the position of the bushing 48 relative to the tool housing 14 at the counterbore 47, which informs the operator of the position of the press block in the internal cavity (e.g., whether it is relatively close to the interior side wall, or relatively far from the interior side wall). The bushing 48 moves into the counterbore 47 when the knob 32 is turned in a first direction (represented by arrow B in FIG. 3) and moves at least partially out of the counterbore 47 when the knob 32 is turned in a second direction (represented by arrow A in FIG. 2). In the embodiment shown, the bushing 48 moves fully out of the counterbore 47 in the fully retracted position of the press block 30. In other embodiments, it may only move partway out, and could include a marker that indicates a fully retracted position.

Next, in step 206, the tube 12 is positioned in the internal cavity 16. Initially, this is by inserting an end 13 of the tube 12 through the entrance opening 22 so that the tube 12 extends at least partially into the internal cavity 16 and is in an initial resting position in the internal cavity 16. If steps 202-210 are repeated one or more times as described herein, positioning the tube in step 206 may be by rotating the tube 12 about its longitudinal axis, may be by inserting the tube 12 further into the internal cavity 16, or both, and may or may not include first withdrawing the tube 12 from the internal cavity 16 before repositioning it in the internal cavity 16 in this manner.

To illustrate the progressive straightening of the tube 12, the tube 12 is illustrated at 12A in an initial bent state prior to any straightening. The tube entrance opening 22 is elongated in a direction from the interior side wall 28 toward the press block 30. The width of the tube entrance opening 22 is the full width of the distance from the groove 56 to the groove 52 when the press block 30 is in the fully retracted state. This elongation will allow a bent end 13 of a tube 12 to be inserted without resistance. Additionally, the internal cavity 16 is sufficiently wide even with the press block 30 in the first cavity portion 16A relative to the size of tube 12 to be straightened that, even for a relatively severely bent tube, the tube 12 is not moved longitudinally against any resistance when being inserted into the internal cavity 16. In other words, if the operator feels resistance when inserting the bent tube into the internal cavity 16, the operator can stop inserting the tube 12, establishing the initial resting position 12A of the tube 12. The tube 12 is then in its initial resting position, shown at 12A.

Next, the method 200 moves to step 208, turning the knob 32 in a first direction (indicated by arrow B in FIG. 3) to move the press block 30 toward the interior side wall 28 and into contact with an exterior of the resting tube at position 12A to force the bent tube at position 12A toward the interior side wall 28. Turning the knob 32 will require more force as the tube 12 is moved from the initial resting position 12A toward a straight position by the press block 30. The force of the press block 30 is against the side of the tube 12, and the tube 12 is not being moved along its length during this step, except for any localized linear movement caused by its unbending. Because the tube 12 is at rest when the press block 30 contacts the side of the tube 12, and the press block 30 provides forces on the tube orthogonally to the longitudinal axis of the tube 12 (if the tube were straight) rather than along a length of the tube 12, and movement of the tube 12 along its longitudinal axis relative to the press block 30 during straightening is minimal.

As the tube contact surface 54 of the press block 30 moves closer to the stationary tube contact surface 50 of the interior side wall 28, the overall bend in the tube 12 is lessened to the distance between these two surfaces. In step 209, the operator determines the position of the press block 30 by determining how much if any of the bushing 48 is visible. When the press block 30 is fully extended and the knob 32 is thus fully tightened, the bushing 48 is fully within the counterbore 47 so that a side surface of the bushing 48 is not visible.

When the press block 30 is moved to the fully extended position of FIG. 3, the semi-circular grooves 52, 56 are adjacent one another, each confronting half of the exterior surface of the tube 12, defining a cylindrical space. Depending on the severity of the bend or bends in the tube 12, the press block 30 may not reach the fully extended state the first time, or even the first several times, that steps 202 to 210 are performed. After one or more repetitions of steps 202-210, the tube 12 will be sufficiently straightened to allow the press block 30 to the fully extended position with the tube 12 within the adjacent grooves 52, 56. When the press block 30 reaches the fully extended position, the longitudinal center axis 62 of the groove 56 will now be coaxial with the longitudinal center axis 60, and the portion of the tube 12 initially inserted (represented as 12A) will be straight.

Next, in step 210, the operator determines whether the tube 12 has been fully inserted into the internal cavity 16 such that the end 13 of the tube 12 is at the interior end wall 26. Step 210 may include sub step 212, verifying that the end 13 of the tube 12 contacts the interior end wall 26 by viewing the end 13 of the tube 12 at the interior end wall 26 through the window 79 extending through the tool housing 14 at the interior end wall 26 and/or through the window 78 in the cover plate 70. The operator may determine from the initial resting position 12A that the tube 12 is not yet with the end 13 at the interior end wall 26, based on tactile feel and visually watching only a short length of the tube 12 entering the internal cavity 16.

If the end 13 of the tube 12 is not verified to be the interior end wall 26, then the method 200 will return to step 202, and the knob 32 is turned in the second direction A to move the press block 30 to the retracted position away from the interior side wall 28 and out of contact with the exterior of the tube 12. Step 204 can then be repeated, and the position of the tube 12 within the internal cavity 16 can then be adjusted in step 206, either by rotating the tube 12 at least partially about its longitudinal axis so that another orientation of the bent tube is presented to the press block 30 for straightening, or, by inserting the tube 12 further into the internal cavity 16 so that the press block 30 can act against a new portion of the tube 12. For illustrative purposes, the tube 12 has a bend in another direction than the initial bend existing when inserted to initial resting position 12A, and is both rotated about its longitudinal axis and further inserted to a subsequent resting position 12B, with the initially straightened portion of the tube 12 inserted further into the internal cavity 16, partway into the tube sleeve 57.

Moreover, in order to ensure that the portion of the tube 12 nearest the end 13 of the tube is protected from scratches and is straight, the tube sleeve 57 may be a first material, such as Aluminum Bronze HR50 per AMS 4640, and the tool housing 14 may be a second material, such as Stainless Steel CRES 15-5 PH per AMS 5659 age hardened to condition H-1025, and the first material may be softer than the second material. For example, the Aluminum Bronze HR50 per AMS 4640 may have a hardness of 94 on the Rockwell Hardness B scale, which is equivalent to a hardness of 15 on the Rockwell Hardness C scale. The Stainless Steel CRES 15-5 PH per AMS 5659 age hardened to condition H-1025 may have a hardness of 39 on the Rockwell Hardness C scale, which is equivalent to a hardness of 111 on the Rockwell Hardness B scale.

Accordingly, after the portion of the tube 12 nearest the end 13 is sufficiently straightened by the press block 30 in the first cavity portion 16A of the internal cavity 16 it can be slid into the linear passage 58 of the tube sleeve 57 without resistance, and, in any event, any resistance would be lessened by the relatively soft material. It remains in the linear passage 58 while a portion of the tube 12 slightly further from the end 13 is now in the first cavity portion 16A of the internal cavity 16, and is straightened by the press block 30.

Steps 202 to 210 are repeated until the press block 30 has been moved to the fully extended position (as verified in step 209) with the end of the tube 12 at the interior end wall 26 in the resting position 12C (as verified in step 210 (and possibly sub-step 212).

The method 200 then proceeds either to step 214 or step 218, which are alternative modes of marking the tube 12 at a predefined distance from the end 13 of the tube 12. In step 214, the press block 30 is left in the fully extended position (e.g., clamped onto the fully inserted and straightened tube 12), and the tube 12 is marked at the portion immediately at the entrance opening 22, as indicated by marking M. This marking may be with ink (e.g., via a pen) or with tape, for example. The tube straightening tool 10 is configured so that a distance D5 from the entrance opening 22 to the interior end wall 26 (shown in FIG. 4) is equal to a predefined distance, which is the length of tube 12 that will be inserted into a connector fitting, for example, and which should therefore be the straight, and without linear scratches along the exterior. By marking the predefined distance, the operator is able to ensure that this portion of the tube 12 is subsequently fully inserted into the connector to provide a secure connection.

Following step 214, the knob 32 is turned in the second direction A in step 216 to withdraw the press block 30, and the straight tube is withdrawn from the tube straightening tool 10 in step 218. The straightened tube 12 may then be used for its purpose (e.g., connected to a fitting for use as a conduit, etc.).

As an alternative to marking the tube 12 in step 214, the method 200 may instead proceed from step 210 to step 216 (skipping step 214), and, after the tube 12 is withdrawn in step 218, the method 200 may proceed to step 220, laying the tube 12 in a linear groove 92 in the exterior 20 of the tool housing 14 until the end 13 of the tube 12 contacts the stop 94, as shown schematically in FIG. 5. Then, in step 222, the tube 12 may be marked with ink or tape at a position along the tube 12 level with the end 21. This marking M (shown in FIG. 5) will be at the same location as the marking M applied in the alternative marking action of step 214 (shown in FIG. 4). In step 224, the tube 12 is then lifted out of the linear groove 92 and the method 200 ends, as the straightened tube may then be used for its purpose (e.g., connected to a fitting for use as a conduit, etc.).

The following Clauses provide example configurations of a tube straightening tool and a method of straightening a tube disclosed herein.

Clause 1. A tube straightening tool for straightening a length of tube, the tube straightening tool comprising: a tool housing defining an internal cavity and having an exterior defining a tube entrance opening that opens into a first end of the internal cavity, a shaft opening orthogonal to the tube entrance opening and that opens into the internal cavity, the tool housing having an interior end wall at a second end of the internal cavity, and the tool housing having an interior side wall extending from the tube entrance opening toward the interior end wall; a press block disposed in the internal cavity; a knob external to the tool housing; a threaded shaft extending from the knob through the shaft opening and into the internal cavity; wherein the press block is coupled to the threaded shaft; wherein turning the knob in a first direction moves the press block in the internal cavity toward the interior side wall, and turning the knob in a second direction opposite from the first direction moves the press block away from the interior side wall.

Clause 2. The tube straightening tool of clause 1, wherein: the interior side wall has a stationary tube contact surface configured as a groove facing the press block and extending lengthwise from the tube entrance opening toward the interior end wall; and the press block has a tube contact surface configured as a groove facing the interior side wall and extending lengthwise parallel with the groove of the stationary tube contact surface.

Clause 3. The tube straightening tool of clause 2, wherein: the groove of the stationary tube contact surface of the interior side wall and the groove of the tube contact surface of the press block are both semi-circular.

Clause 4. The tube straightening tool of any of clauses 2-3, wherein the internal cavity has a first cavity portion adjacent the tube entrance opening and a second cavity portion adjacent the interior end wall, and the tube straightening tool further comprising: a tube sleeve disposed in the second cavity portion; wherein the tube sleeve has a linear passage extending lengthwise through the tube sleeve from a first end of the tube sleeve at the first cavity portion to a second end of the tube sleeve at the interior end wall; and wherein a longitudinal center axis of the linear passage aligns with a longitudinal center axis of the groove of the stationary tube contact surface of the interior side wall.

Clause 5. The tube straightening tool of clause 4, wherein the tube sleeve is a first material, the tool housing is a second material, and the first material is softer than the second material.

Clause 6. The tube straightening tool of any of clauses 1-5, wherein the tube entrance opening is elongated in a direction from the interior side wall toward the press block.

Clause 7. The tube straightening tool of any of clauses 1-6, wherein the tool housing has a counterbore at the exterior of the tool housing around the shaft opening, and the tube straightening tool further comprising: a bushing fixed to the threaded shaft; wherein the bushing moves at least partially into the counterbore when the knob is turned in the first direction and moves at least partially out of the counterbore when the knob is turned in the second direction.

Clause 8. The tube straightening tool of any of clauses 1-7, wherein the press block has a blind hole extending partially through the press block; wherein the threaded shaft extends into the blind hole; wherein the press block has a shaft access opening extending at least partially through the press block orthogonal to and in communication with the blind hole; and the tube straightening tool further comprising: a retainer clip having a notch, and disposed in the shaft access opening with a narrowed portion of the threaded shaft in the notch to fix the threaded shaft axially relative to the press block.

Clause 9. The tube straightening tool of clause 8, wherein the tool housing has internal threads at the shaft opening, the threaded shaft has an externally-threaded portion that threads to the internal threads, a terminal end portion opposite the knob, and the narrowed portion between the externally-threaded portion and the terminal end portion; wherein a diameter of the narrowed portion is less than a diameter of the terminal end portion and less than a diameter of the externally-threaded portion; and wherein a width of the notch is less than the diameter of the terminal end portion and less than the diameter of the externally-threaded portion, the shaft access opening is wider than the blind hole, and wider than the retainer clip.

Clause 10. The tube straightening tool of any of clauses 1-9, wherein the tool housing defines a window extending through the tool housing to the internal cavity at the interior end wall.

Clause 11. The tube straightening tool of any of clauses 1-10, wherein the exterior of the tool housing has a first ridge, a second ridge spaced from the first ridge, and a tool mount portion recessed between the first ridge and the second ridge.

Clause 12. The tube straightening tool of any of clauses 1-11, further comprising: a cover plate fastenable to tool housing to enclose the internal cavity.

Clause 13. The tube straightening tool of clause 12, wherein the cover plate defines a window extending through the cover plate to the internal cavity at the interior end wall when the cover plate is fastened to the tool housing.

Clause 14. A method of straightening a tube, the method comprising: inserting an end of a tube at least partially into an internal cavity of a tool housing through an entrance opening at an exterior of the tool housing so that the tube is in an initial resting position in the internal cavity; wherein the entrance opening opens into a first end of the internal cavity; the tool housing having an interior end wall at a second end of the internal cavity, and the tool housing having an interior side wall extending from the entrance opening to the interior end wall; and turning a knob disposed at the exterior of the tool housing in a first direction to move a press block coupled to on a shaft connected to the knob toward the interior side wall and into contact with an exterior of the tube to force the tube toward the interior side wall.

Clause 15. The method of clause 14, further comprising: turning the knob in a second direction to move the press block away from the interior side wall and out of contact with the exterior of the tube; adjusting a position of the tube within the internal cavity to a subsequent resting position; and turning the knob in the first direction to move the press block toward the interior side wall and into contact with the exterior of the tube to force the tube toward interior the side wall.

Clause 16. The method of clause 15, wherein adjusting the position of the tube includes rotating the tube at least partially around a longitudinal axis of the tube.

Clause 17. The method of any of clauses 15-16, wherein adjusting the position of the tube includes inserting the tube until an end of the tube contacts the interior end wall.

Clause 18. The method of any of clauses 14-17, further comprising: verifying that the end of the tube contacts the interior end wall.

Clause 19. The method of clause 18, wherein verifying that the end of the tube contacts the interior end wall comprises viewing the end of the tube at the interior end wall through a window extending through the tool housing at the interior end wall.

Clause 20. The method of any of clauses 14-19, further comprising: marking the tube at a predefined distance from the end of the tube by one of laying the tube in a linear groove in the exterior of the tool housing, the linear groove having a length equal to the predefined distance; or marking the tube at the entrance opening after inserting the tube until the end of the tube contacts the interior end wall, a distance from the entrance opening to the interior end wall equal to the predefined distance.

While several modes for carrying out the many aspects of the present teachings have been described in detail, those familiar with the art to which these teachings relate will recognize various alternative aspects for practicing the present teachings that are within the scope of the appended claims. It is intended that all matter contained in the above description or shown in the accompanying drawings shall be interpreted as illustrative and exemplary of the entire range of alternative embodiments that an ordinarily skilled artisan would recognize as implied by, structurally and/or functionally equivalent to, or otherwise rendered obvious based upon the included content, and not as limited solely to those explicitly depicted and/or described embodiments. Moreover, the present concepts expressly include combinations and sub-combinations of the described elements and features. The detailed description and the drawings are supportive and descriptive of the present teachings, with the scope of the present teachings defined solely by the claims.

The invention claimed is:

1. A tube straightening tool for straightening a length of tube, the tube straightening tool comprising: a tool housing defining an internal cavity and having an exterior defining a tube entrance opening that opens into a first end of the internal cavity, a shaft opening orthogonal to the tube entrance opening and that opens into the internal cavity, the internal cavity having an interior end wall at a second end of the internal cavity, and the internal cavity having an interior side wall extending from the tube entrance opening to the interior end wall; a press block disposed in the internal cavity; a knob external to the tool housing; and a threaded shaft extending from the knob through the shaft opening and into the internal cavity; wherein the press block is coupled to the threaded shaft; and wherein turning the knob in a first direction moves the press block in the internal cavity toward the interior side wall, and turning the knob in a second direction opposite from the first direction moves the press block away from the interior side wall.

2. The tube straightening tool of claim 1, wherein:

the interior side wall has a stationary tube contact surface configured as a groove facing the press block and extending lengthwise from the tube entrance opening toward the interior end wall; and the press block has a tube contact surface configured as a groove facing the interior side wall and extending lengthwise parallel with the groove of the stationary tube contact surface.

3. The tube straightening tool of claim 2, wherein:

the groove of the stationary tube contact surface of the interior side wall and the groove of the tube contact surface of the press block are both semi-circular.

4. The tube straightening tool of claim 2, wherein the internal cavity has a first cavity portion adjacent the tube entrance opening and a second cavity portion adjacent the interior end wall, and the tube straightening tool further comprising:

a tube sleeve disposed in the second cavity portion; wherein the tube sleeve has a linear passage extending lengthwise through the tube sleeve from a first end of the tube sleeve at the first cavity portion to a second end of the tube sleeve at the interior end wall; and wherein a longitudinal center axis of the linear passage aligns with a longitudinal center axis of the groove of the stationary tube contact surface of the interior side wall.

5. The tube straightening tool of claim 4, wherein the tube sleeve is a first material, the tool housing is a second material, and the first material is softer than the second material.

6. The tube straightening tool of claim 1, wherein the tube entrance opening is elongated in a direction from the interior side wall toward the press block.

7. The tube straightening tool of claim 1, wherein the tool housing has a counterbore at the exterior of the tool housing around the shaft opening, and the tube straightening tool further comprising:

a bushing fixed to the threaded shaft; wherein the bushing moves at least partially into the counterbore when the knob is turned in the first direction and moves at least partially out of the counterbore when the knob is turned in the second direction.

8. The tube straightening tool of claim 1, wherein the press block has a blind hole extending partially through the press block; wherein the threaded shaft extends into the blind hole; wherein the press block has a shaft access opening extending at least partially through the press block orthogonal to and in communication with the blind hole; and the tube straightening tool further comprising:

a retainer clip having a notch, and disposed in the shaft access opening with a narrowed portion of the threaded shaft in the notch to fix the threaded shaft axially relative to the press block.

9. The tube straightening tool of claim 8, wherein the tool housing has internal threads at the shaft opening, the threaded shaft has an externally-threaded portion that threads to the internal threads, a terminal end portion opposite the knob, and the narrowed portion between the externally-threaded portion and the terminal end portion;

wherein a diameter of the narrowed portion is less than a diameter of the terminal end portion and less than a diameter of the externally-threaded portion; and wherein a width of the notch is less than the diameter of the terminal end portion and less than the diameter of the externally-threaded portion, the shaft access opening is wider than the blind hole, and wider than the retainer clip.

10. The tube straightening tool of claim 1, wherein the tool housing defines a window extending through the tool housing to the internal cavity at the interior end wall.

11. The tube straightening tool of claim 1, wherein the exterior of the tool housing has a first ridge, a second ridge spaced from the first ridge, and a tool mount portion recessed between the first ridge and the second ridge.

12. The tube straightening tool of claim 1, further comprising:

a cover plate fastenable to tool housing to enclose the internal cavity.

13. The tube straightening tool of claim 12, wherein the cover plate defines a window extending through the cover plate to the internal cavity at the interior end wall when the cover plate is fastened to the tool housing.

14. A method of straightening a tube, the method comprising: inserting an end of a tube at least partially into an internal cavity of a tool housing through an entrance opening at an exterior of the tool housing so that the tube is in an initial resting position in the internal cavity; wherein the entrance opening opens into a first end of the internal cavity; the internal cavity having an interior end wall at a second end of the internal cavity, and the internal cavity having an interior side wall extending from the entrance opening to the interior end wall; and turning a knob disposed at the exterior of the tool housing in a first direction to move a press block coupled to on a shaft connected to the knob toward the interior side wall and into contact with an exterior of the tube to force the tube toward the interior side wall.

15. The method of claim 14, further comprising:

turning the knob in a second direction to move the press block away from the interior side wall and out of contact with the exterior of the tube;

adjusting a position of the tube within the internal cavity to a subsequent resting position; and turning the knob in the first direction to move the press block toward the interior side wall and into contact with the exterior of the tube to force the tube toward interior the side wall.

16. The method of claim 15, wherein adjusting the position of the tube includes rotating the tube at least partially around a longitudinal axis of the tube.

17. The method of claim 15, wherein adjusting the position of the tube includes inserting the tube until an end of the tube contacts the interior end wall.

18. The method of claim 17, further comprising:

verifying that the end of the tube contacts the interior end wall.

19. The method of claim 18, wherein verifying that the end of the tube contacts the interior end wall comprises viewing the end of the tube at the interior end wall through a window extending through the tool housing at the interior end wall.

20. The method of claim 14, further comprising:

marking the tube at a predefined distance from the end of the tube by one of:

laying the tube in a linear groove in the exterior of the tool housing, the linear groove having a length equal to the predefined distance; or marking the tube at the entrance opening after inserting the tube until the end of the tube contacts the interior end wall, a distance from the entrance opening to the interior end wall equal to the predefined distance.

* * * * *